US006000775A

United States Patent [19]

Muraki

[11] Patent Number: 6,000,775

[45] Date of Patent: Dec. 14, 1999

[54] INK JET PRINTER WITH A FIXED POSITIONAL RELATIONSHIP BETWEEN A CAPPING MECHANISM AND PRINTHEAD

[75] Inventor: Motohito Muraki, Nagoya, Japan

[73] Assignee: Brother Kogyo Kabushiki Kaisha, Nagoya, Japan

[21] Appl. No.: 08/951,544

[22] Filed: Oct. 16, 1997

[30] Foreign Application Priority Data

Nov. 13, 1996 [JP] Japan ..... 8-301462

[51] Int. Cl.[6] ..... B41J 25/308; B41J 2/165

[52] U.S. Cl. ..... 347/8; 347/30

[58] Field of Search ..... 347/8, 22, 29, 347/30

[56] References Cited

U.S. PATENT DOCUMENTS

| | | | |
|---|---|---|---|
| 4,676,675 | 6/1987 | Suzuki et al. | 400/56 |
| 5,156,464 | 10/1992 | Sakai | 400/56 |
| 5,187,497 | 2/1993 | Hirano et al. | 347/8 |
| 5,479,194 | 12/1995 | Hirano et al. | 347/22 |
| 5,700,095 | 12/1997 | Sugiyama | 400/55 |
| 5,710,580 | 1/1998 | Otsuka et al. | 347/32 |
| 5,717,444 | 2/1998 | Sugimoto et al. | 347/29 |

FOREIGN PATENT DOCUMENTS

| | | | |
|---|---|---|---|
| 58-168569 | 10/1983 | Japan . | |
| 1-075248 | 3/1989 | Japan | 347/8 |
| 7-40533 | 2/1995 | Japan . | |
| 9-254401 | 3/1996 | Japan . | |
| 8-207388 | 8/1996 | Japan . | |

*Primary Examiner*—Edgar Burr
*Assistant Examiner*—Daniel J. Colilla
*Attorney, Agent, or Firm*—Oliff & Berridge, PLC

[57] ABSTRACT

The position of a guide rail is changed by eccentrically rotating the guide rail by turning a control lever, thereby adjusting an amount of a head gap. A supporting frame for supporting a capping mechanism is connected to the guide rail. When the position of the guide rail is changed for the head gap adjustment, the position of the capping mechanism is also changed. Consequently, even when the position of the guide rail is changed for the head gap adjustment, the positional relation between the capping mechanism and the print head can be almost fixedly maintained.

24 Claims, 5 Drawing Sheets

INK JET PRINTER WITH A FIXED POSITIONAL RELATIONSHIP BETWEEN A CAPPING MECHANISM AND PRINTHEAD

BACKGROUND OF THE INVENTION

1. Field of Invention

The invention relates to a printing apparatus for recording onto a recording medium by jetting ink fluid.

2. Description of Related Art

A printing apparatus for recording onto a recording medium by jetting ink is known. The known apparatus has a print head for printing by jetting ink onto a recording medium, a carriage on which the print head is mounted and which is provided so as to be movable along a guide rail, and carriage moving means for moving the carriage. In such an apparatus, in order to assure a predetermined printing performance upon assembly and to assure a preferable printing performance irrespective of the thickness of a recording medium, gap instructing means or a gap adjusting mechanism for setting the amount of a head gap as an interval between the print head and the recording medium (the surface of a platen) is provided.

Also known is a printing apparatus for which the user sets the amount of the head gap on the basis of the gap instructing means, thereby adjusting the head gap by using the gap adjusting mechanism. In order to maintain a preferable ink discharging state of the print head, a purging device for sucking and removing ink in the print head, while covering the print head by a suction cap, and a wiping device for wiping a nozzle face of the print head by a wiping member are known.

At the time of adjustment of the head gap, when the position of the print head is changed in order to adjust the interval between the recording medium and the print head, the interval between the suction cap or wiping member and the print head is accordingly changed.

Especially, when the print head is moved so as to be away from the recording medium in order to adjust the head gap, the interval between the suction cap or wiping member and the print head is widened. As a result, in these known printing apparatuses, the air tightness of the suction cap covering the nozzle face of the print head is deteriorated and the ink in the head cannot be effectively sucked. The wiping member also cannot wipe the nozzle face of the head with a necessary force to obtain proper cleaning. As mentioned above, when the distance between the suction cap or wiping member and the print head is changed, there is a problem that the capping performance of the suction cap and the wiping performance of the wiping member vary and are degraded in at least some cases.

SUMMARY OF THE INVENTION

In order to minimize the effects due to the variation in the head recovering performance, the following method could be applied. First, the stroke of the suction cap or wiping member to the print head can be increased or decreased according to the head gap adjustment amount so that the capping by the suction cap and the wiping by the wiping member can be properly performed.

According to the above-mentioned method, however, there is a problem such that the apparatus for increasing or decreasing the stroke amount becomes large and the printing apparatus itself accordingly becomes large. When a wiping load varies due to an increase in variation of a lap amount of the wiping member and the print head at the time of wiping, there are cases that a coating such as a water-repellent film on the nozzle surface is peeled and the ink is left on the wiped nozzle surface.

The invention is made in consideration of the above problems and it is an object of the invention to provide a printing apparatus in which the positional relationship between a capping mechanism and a print head can be maintained at all times.

According to a first feature of the invention, there is provided a printing apparatus comprising a print head for printing onto a recording medium by jetting ink; a carriage on which the print head is mounted and which is provided movably along a guide rail; and a capping mechanism having a cap that air-tightly covers a nozzle face of the print head, which allows the cap to move to come into contact with the nozzle surface of the print head, wherein the apparatus has a gap adjusting mechanism for adjusting an amount of a head gap as an interval between the print head and the recording medium; and a capping mechanism moving mechanism for moving the capping mechanism in association with the head gap adjustment by the gap adjusting mechanism.

The amount of the head gap is consequently adjusted by the gap adjusting mechanism and the capping mechanism is also moved, so that the positional relationship between the capping mechanism and the print head can be maintained.

According to a second feature of the invention, the head gap adjustment by the gap adjusting mechanism and movement of the capping mechanism by the capping mechanism moving mechanism are performed by moving the guide rail. According to a third feature of the invention, there is also provided a supporting frame that supports the capping mechanism and has a part to which the guide rail is fit, and a part of the carriage is fit to the guide rail.

Consequently, by changing the position of the guide rail for the head gap adjustment, the capping mechanism is moved accordingly. Thus, the positional relationship between the carriage and the capping device can be maintained.

According to a fourth feature of the invention, the gap adjusting mechanism has a supporting part supporting the guide rail so as to be eccentrically turnable and a control lever that is connected to the guide rail and eccentrically rotates the guide rail in accordance with a head gap. By eccentrically turning the guide rail by the control lever, the position of the guide rail is changed according to the head gap. Thus, the head gap can be easily adjusted.

According to a fifth feature of the invention, the guide rail can be moved to either a first position in the case of a thick recording medium or a second position in the case of a thin recording medium.

According to a sixth feature of the invention, the supporting frame supports not only the capping mechanism but also a wiping member for wiping the nozzle face of the print head. Consequently, the positional relationship between the wiping member and the print head can be maintained.

According to a seventh feature of the invention, the capping mechanism is linked to a purging mechanism for sucking ink in the print head in connection with the capping mechanism. Therefore, the ink in the print head can be sucked by the purging mechanism.

BRIEF DESCRIPTION OF THE DRAWINGS

A preferred embodiment of the invention will be described in detail with reference to the following figures wherein.

DETAILED DESCRIPTION OF PREFERRED EMBODIMENTS

An embodiment of the invention will be described hereinbelow with reference to the drawings.

Figure 1:
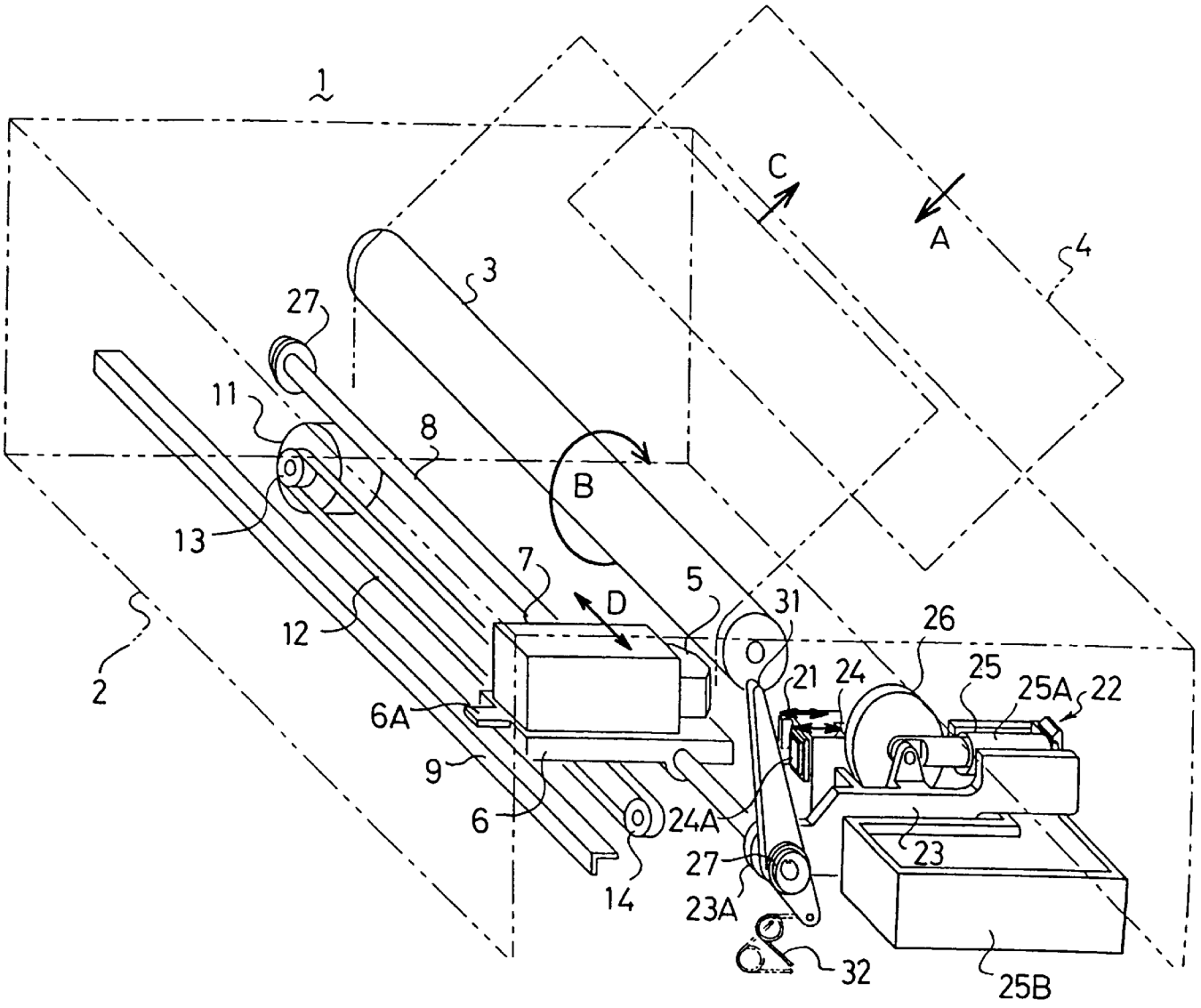
FIG. 1 is a perspective view showing a schematic structure of a printing apparatus of the embodiment.

As shown in FIG. 1, a printing apparatus 1 has a cylindrical platen roller 3 rotatably supported by an apparatus frame 2 by a rotary shaft (not shown) extending in the lateral direction. The platen roller 3 is a part of a paper feeder and conveys a printing sheet 4 (recording medium) fed from a paper feeding cassette or a manual paper feeding portion so as to face an ink-jet print head 5.

The printing sheet 4 is fed from a sheet supplying port (not shown) on the rear side of the apparatus frame 2 in the direction of an arrow A, fed in the direction of an arrow B by the rotation of the platen roller 3, and ejected in the direction of an arrow C from a sheet ejecting port (not shown). A carriage 6 is provided in front of the platen roller 3 so as to be movable in the direction of an arrow D parallel to the axis of the platen roller 3. The print head 5 and an ink cartridge 7 housing ink to be supplied to the print head 5 are detachably mounted on the carriage 6.

A guide rail 8 provided in parallel with the axis of the platen roller 3 is slidably inserted through an opening in the lower side of the carriage 6. With such a structure, the print head 5 mounted on the carriage 6 can reciprocate by sliding along the axis of the platen roller 3. An engagement part 6A is formed on the rear (i.e., away from the platen roller) side of the carriage 6 and is slidably engaged with a guiding member 9 provided in parallel with the guide rail 8. The engagement of the engaging part 6A with the guiding member 9 prevents the carriage 6 from rotating around the guide rail 8.

Carriage moving means for reciprocating the carriage 6 is structured to drive the carriage 6 using a carriage driving motor 11 via a belt 12 and pulleys 13, 14.

A recovery area for recovering clogged or jetting defective ink from the print head 5 is formed on the right side (as defined by an operator positioned to the left in FIG. 1 and facing the printing apparatus) of a printing area corresponding to the platen roller 3. In the recovery area, a wiping member 21 for wiping the nozzle surface of the print head 5 and a purging device 22 for sucking residual ink in the print head 5 are provided as recovery devices.

The wiping member 21 and purging device 22 are supported on a supporting frame 23. The details are shown in FIGS. 2A to 2D. For the ink-jet print head 5 print problems that are encountered include defective jetting due to the occurrence of bubbles in the print head 5, adherence of ink on the jetting surface, or the like during use of the printing apparatus 1. Recovery devices, including the wiping member 21 and the purging device 22, are provided to address the problems.

One end of the supporting frame 23 has an extended part 23A for receiving the guide rail 8. The other end of the supporting frame 23 has engagement parts 23B, 23C which are supported by a supporting part 2A of the apparatus frame 2 and allow the wiping member 21 and the purging device 22 to move in a direction transverse to the axis of the platen roller 3.

With such a structure, when a control lever 31 which will be described below is operated, the wiping member 21 and the purging device 22, supported by the supporting frame 23, move in a direction transverse to the axis of the platen roller 3 in association with movement of the guide rail 8 while maintaining the state where the engagement parts 23B and 23C are supported by the supporting part 2A.

The wiping member 21 and the purging device 22 can move between an operating position which is in a moving route of the print head 5 to perform the recovery operation and a waiting position retreated from the moving route of the print head 5. The purging device 22 has a capping mechanism 24 having a suction cap 24A which comes into contact with the print head 5 and covers the nozzle surface and a purging mechanism 25 connected to the cap 24A. When the nozzle surface of the print head 5 is air-tightly covered by the suction cap 24A at the operating position of the print head 5, the purging mechanism 25 generates a negative pressure using a suction pump 25A and sucks and discharges residual ink in the print head 5 into a waste liquid tank 25B, thereby recovering the desired ink jetting performance. The movement of the wiping member 21 and the suction cap 24A between the waiting and operating positions is mechanically controlled by cam grooves formed on a cam member 26.

Figure 2A:
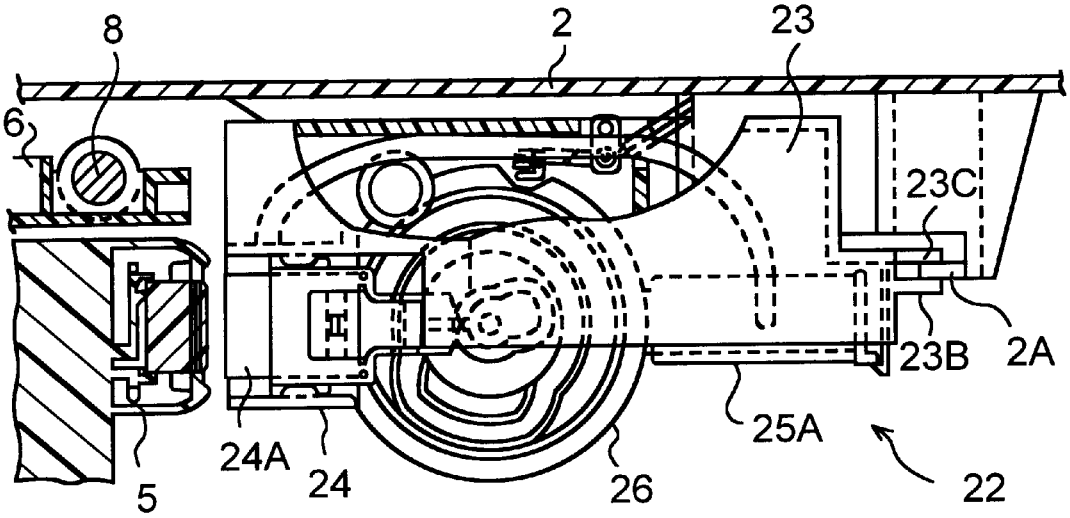
FIG. 2A is a partial cross section of a capping mechanism as seen from a platen side, i.e., inverted or upside down.
Figure 2B:
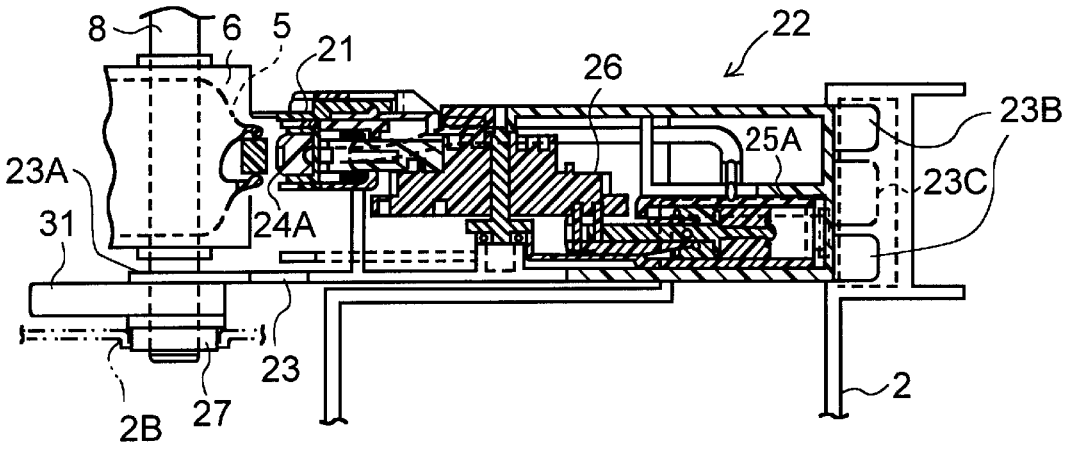
FIG. 2B is a cross section taken on line 2—2 of FIG. 2C.

Both ends of the guide rail 8 are supported by supporting parts 2B (only one of them is shown in FIG. 2B) of the apparatus frame 2 via an eccentric cam 27 so as to eccentrically rotate. The control lever 31 and the extended part 23A of the supporting frame 23 are attached to the guide rail 8. The eccentric cam 27 is rotatably fit to the outer peripheral face of the guide rail 8 so as to operate integrally with the control lever 31 and holds the guide rail 8 rotatably with a predetermined eccentricity amount. With respect to the eccentric cam 27 and the guide rail 8, the center 27A of the eccentric cam 27 shown in FIG. 2D and the center of the guide rail 8 are offset from each other to obtain a predetermined eccentricity amount.

As mentioned above, the eccentric cam 27 fitted to the guide rail 8 is supported by the supporting parts 2B of the apparatus frame 2. Consequently, when the control lever 31 is turned, it turns around the center 27A of the eccentric cam 27. In association with the turn of the control lever 31, the guide rail 8 is moved in the horizontal direction (in the direction of an arrow E shown in FIG. 2D when the control lever 31 moves from the solid line position to the dash two dot line position and vice versa) to and from the recording sheet.

Movement of the carriage 6 mounted to the guide rail 8 and the wiping member 21 and the purging device 22 supported by the supporting frame 23 in association with the turn of the control lever 31 will be described.

As mentioned above, the control lever 31 is attached to the guide rail 8 so that the center 27A of the eccentric cam 27 and the center of the guide rail 8 are offset from each other. When the printing operation is performed for a thin recording sheet, the control lever 31 is turned clockwise so that it is moved from a position P1 to a position P2 shown in FIG. 2D. Since the control lever 31 is turned around the center 27A of the eccentric cam 27, the guide rail 8 is horizontally moved by a distance (L) in the direction of the arrow E shown in FIG. 2D (or returned the distance (L) when the control lever 31 is returned to the solid line position).

Figure 2C:
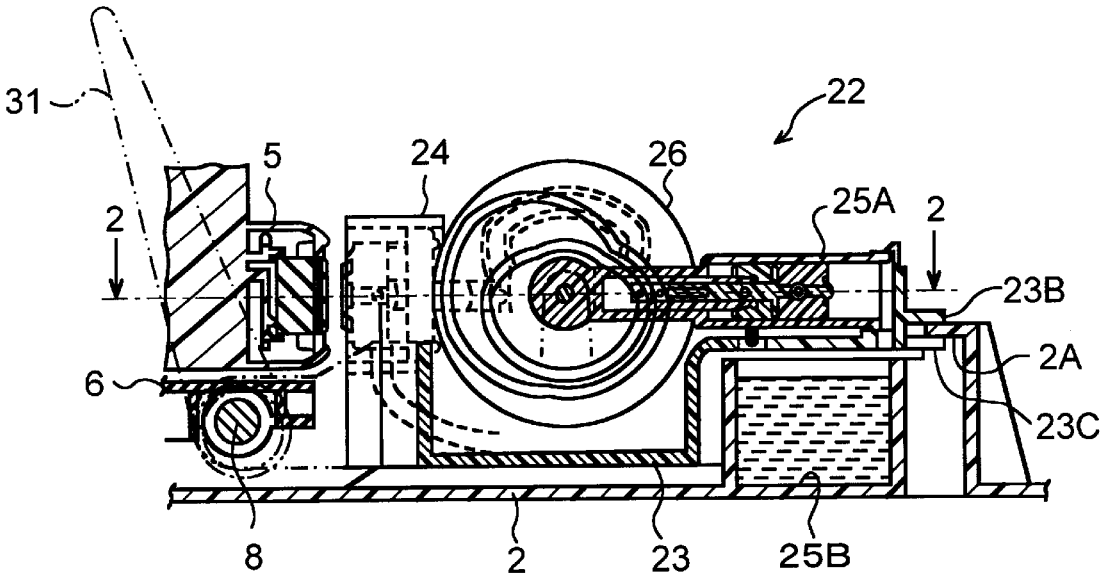
FIG. 2C is a vertical section of the capping mechanism.
Figure 2D:
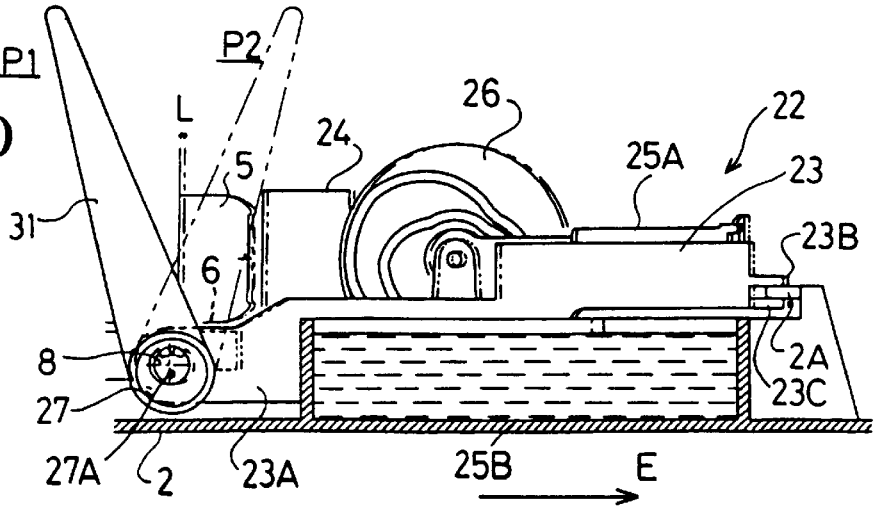
FIG. 2D a partial cross section of the capping mechanism as seen from the opposite side of FIG. 2A.

Since the carriage 6 attached to the guide rail 8 is also horizontally moved by the distance (L) in the direction of the arrow E shown in FIG. 2D in association with the movement of the guide rail 8, the head gap is reduced. The guide rail 8 is also fit to the extended part 23A of the supporting frame 23. Consequently, when the control lever 31 is turned to move the guide rail 8 for the head gap adjustment, the supporting member 23 supporting the wiping member 21 and the purging device 22 is also horizontally moved by the distance (L) in the direction of the arrow E shown in FIG. 2D (or returned the distance (L) described above).

When the control lever 31 is positioned at P1, the print head 5, carriage 6 and purging device 22 are at positions shown by solid line in FIG. 2D and double dotted line in FIG. 2C. On the other hand, when the control lever 31 is positioned at P2, the print head 5, carriage 6 and purging device 22 are at the position shown by double dotted line in FIG. 2D.

Thus, when the printing operation is performed for a thick recording sheet, the control lever 31 is turned counterclockwise to move from the position P2 to the position P1 shown in FIG. 2D. Since the guide rail 8 is horizontally moved in the direction opposite to the arrow E shown in FIG. 2D by the distance (L), both of the print head 5 and the supporting member 23 supporting the wiping member 21 and the purging device 22 are also horizontally moved in the direction opposite to the arrow E by the distance (L).

As shown in FIG. 1, a spring member 32 is connected to a connecting end of the control lever 31 in order to hold the control lever 31 at either the first position P1 or the second position P2 by regulating the turn of the control lever 31.

As mentioned above, the control lever 31 is integrally formed with the eccentric cam 27 and the guide rail 8 is fit into the control lever 31 via the eccentric cam 27. Consequently, when the control lever 31 integrally moving with the eccentric cam 27 is turned around the center 27A of the eccentric cam 27, the guide rail 8 is eccentrically rotated and the position of the guide rail 8 is moved. Since the carriage 6 and the extended part 23A are attached to the guide rail 8, the positions of the carriage 6 and the supporting frame 23 are also moved in association with the movement of the guide rail 8. By the movement, the amount of the head gap is adjusted. In association with the movement of the position of the guide rail 8 for adjusting the head cap, the supporting frame 23 supporting the wiping member 21 and the purging device 22 is also moved by the movement amount of the guide rail 8.

As mentioned above, when the carriage 6 is moved for the head gap adjustment, the wiping member 21 and the purging device 22 are also simultaneously moved in the same direction by the same distance. The distance between the wiping member 21 or the suction cap 24A of the purging device 22 and the print head 5 is therefore maintained even when head gap adjustment is performed.

When the head gap is changed, it is therefore unnecessary to increase or decrease the stroke of the suction cap 24A to the print head 5. Any adverse effect of the head gap adjustment on the recovery operation for the printer head is avoided and it is unnecessary to enlarge the purging device 22. Also, there is no variation in the lap amount of the wiping member 21 and the print head 5 at the time of the wiping operation. It can be consequently avoided that the coating, such as a water-repellent film, on the nozzle surface of the printer head 5 is peeled or that ink is left on the wiped nozzle surface due to the variation in the wiping load.

It is to be understood that the invention is not restricted to the particular forms shown in the foregoing embodiment. Various modifications and alterations can be made thereto without departing from the scope of the invention encompassed by the appended claims.

What is claimed is:

1. A printing apparatus, comprising:

a platen across which a recording medium is fed;

a print head for printing onto the recording medium by jetting ink;

a carriage on which the print head is mounted, the carriage being provided movably along a guide rail;

a capping mechanism having a cap for air-tightly covering a nozzle surface of the print head, the capping mechanism making the cap come into contact with the nozzle surface of the print head;

a gap adjusting mechanism for adjusting an amount of a head gap between the print head and the platen to accommodate at least two different thicknesses of recording medium; and a capping mechanism moving mechanism for moving the capping mechanism in a fixed relationship with the carriage during head gap adjustment by the gap adjusting mechanism in accordance with the thickness of the recording medium being used.

2. The printing apparatus according to claim 1, the gap adjusting mechanism comprising an eccentric collar mounted to the guide rail, the eccentric collar rotatably supported in the printing apparatus, wherein the head gap adjustment by the gap adjusting mechanism and movement of the capping mechanism by the capping mechanism moving mechanism result from movement of the guide rail upon rotation of the eccentric collar.

3. The printing apparatus according to claim 2, further comprising a supporting frame supporting the capping mechanism and having a portion which is fit to the guide rail, wherein a portion of the carriage is mounted to the guide rail.

4. The printing apparatus according to claim 3, wherein the gap adjusting mechanism further comprises a control lever that is connected to the guide rail and eccentrically rotates the guide rail in accordance with the head gap adjustment.

5. The printing apparatus according to claim 4, wherein the guide rail can be moved either to a first position when a recording medium is thick or to a second position in a case where the recording medium is thin.

6. The printing apparatus according to claim 1, wherein the capping mechanism is connected to a purging mechanism for sucking ink in the print head in relation to the capping mechanism.

7. An adjustable cleaning mechanism for a printing apparatus, the printing apparatus having a platen and a defined print area within a length of the platen, a carriage mounting at least one print head slideably mounted to a guide rail for reciprocal movement opposite and parallel to the platen, the adjustable cleaning mechanism comprising:

a supporting frame attached at one end to the guide rail;

a purging mechanism having a suction cap for each print head extendibly mounted to the supporting frame;

an eccentric collar mounted to the guide rail, a center of the eccentric collar offset from a center axis of the guide rail; and a control lever attached to the eccentric collar and movable over a continuum of intermediate positions from a first position to a second position, wherein the supporting frame is positioned to a side of the defined print area and movement of the control lever between the first position and the second position causes the guide rail to move toward and away from the platen.

8. The adjustable cleaning mechanism according to claim 7, further comprising a resilient member attached between the control lever and the printing apparatus for retaining the control member in one of the first position and the second position.

9. The adjustable cleaning mechanism according to claim 7, wherein movement of the control lever from the first position to the second position, and from the second position to the first position, thereby rotating the eccentric collar causes the guide rail to be displaced a predetermined distance.

10. The adjustable cleaning mechanism according to claim 9, wherein the carriage and the supporting frame are equally displaced the distance the guide rail is displaced.

11. The adjustable cleaning mechanism according to claim 7, wherein the supporting frame further comprises a slideable attachment mechanism for attaching an end of the supporting frame, opposite to the one end attached to the guide rail, to the printer.

12. The adjustable cleaning mechanism according to claim 7, wherein the supporting frame has an opening through which the guide rail passes.

13. The adjustable cleaning mechanism according to claim 7, further comprising a wiping member extendibly mounted to the supporting frame.

14. An ink jet printer having a carriage for mounting at least one print head/ink cartridge system for reciprocal movement along a guide rail and opposed to a platen, further comprising:

a print head cleaning apparatus mounted at one end to the guide rail; and means for moving the guide rail toward and away from the platen, wherein a positional relationship of the carriage and the print head cleaning mechanism is unchanged by the movement of the guide rail.

15. The ink jet printer according to claim 14, wherein the guide rail has a round cross section and passes through a hole in each of the carriage and the print head cleaning apparatus.

16. The ink jet printer according to claim 15, wherein the print head cleaning apparatus comprises:

a supporting frame;

a wiping mechanism mounted to the supporting frame; and a suction mechanism mounted to the supporting frame, wherein the guide rail passes through the supporting frame.

17. The ink jet printer according to claim 14, wherein the means for moving comprises:

an eccentric collar mounted to each end of the guide rail, the eccentric collar received at each end in a frame of the ink jet printer; and a control lever attached to the eccentric collar at at least one end of the guide rail, wherein a center of each eccentric collar is offset from a center axis of the guide rail.

18. The ink jet printer according to claim 17, the means for moving further comprising a position setting device for holding the control lever at a first position or a second position.

19. A printing apparatus, comprising:

a platen across which a recording medium is fed;

a print head for printing onto the recording medium by jetting ink;

a capping mechanism having a cap for air-tightly covering a nozzle surface of the print head; and a moving mechanism for moving the print head and adjusting an amount of a head gap between the print head and the platen to accommodate at least two different thicknesses of recording medium, the moving mechanism moving the capping mechanism in a fixed relationship with the print head during head gap adjustment in accordance with the thickness of the recording medium being used.

20. The printing apparatus according to claim 19, wherein the moving mechanism includes a guide rail and the print head and the capping mechanism are moved by moving the guide rail.

21. The printing apparatus according to claim 20, further comprising a supporting frame supporting the capping mechanism, wherein the supporting frame and the carriage are mounted to the guide rail.

22. The printing apparatus according to claim 21, wherein the moving mechanism includes an eccentric collar and a control lever, the eccentric collar being mounted to the guide rail and the control lever being connected to the eccentric collar, the moving mechanism eccentrically rotates the guide rail in accordance with the head gap adjustment.

23. The printing apparatus according to claim 22, wherein the carriage and the supporting frame are both moved the same distance the guide rail is moved.

24. The printing apparatus according to claim 21, wherein the carriage and the supporting frame each have an opening through which the guide rail passes.

* * * * *